US012497719B2

(12) United States Patent
Zheng

(10) Patent No.: US 12,497,719 B2
(45) Date of Patent: Dec. 16, 2025

(54) MULTI-MEMBER KNITTING NEEDLES AND METHODS FOR MAKING THE SAME

(71) Applicant: Westing Bridge LLC, Troy, MI (US)

(72) Inventor: Liyun Zheng, Troy, MI (US)

(73) Assignee: Westing Bridge LLC, Troy, MI (US)

( * ) Notice: Subject to any disclaimer, the term of this patent is extended or adjusted under 35 U.S.C. 154(b) by 0 days.

(21) Appl. No.: 18/433,963

(22) Filed: Feb. 6, 2024

(65) Prior Publication Data

US 2024/0328044 A1 Oct. 3, 2024

Related U.S. Application Data

(60) Provisional application No. 63/455,859, filed on Mar. 30, 2023.

(51) Int. Cl.
*D04B 3/02* (2006.01)

(52) U.S. Cl.
CPC ..... *D04B 3/02* (2013.01)

(58) Field of Classification Search
CPC ..... D04B 3/02; D04B 3/00; D04B 9/02
USPC ..... 66/121, 123, 116, 117
See application file for complete search history.

(56) References Cited

U.S. PATENT DOCUMENTS

| | | | |
|---|---|---|---|
| 1,269,014 | A | 6/1918 | Stansbery |
| D54,688 | S | 3/1920 | Schoettel |
| 1,960,133 | A | 5/1934 | Garo |
| 1,989,352 | A | 1/1935 | Davis |
| 1,999,691 | A | 4/1935 | Ghaham |
| D99,273 | S | 4/1936 | Ellis |
| 2,043,958 | A | 6/1936 | Engel |
| 2,061,282 | A | 11/1936 | Leboff et al. |
| 2,093,631 | A | 9/1937 | Burnham |
| 2,094,262 | A | 9/1937 | Burnham |

(Continued)

FOREIGN PATENT DOCUMENTS

| | | | |
|---|---|---|---|
| CH | 361880 | A | 5/1962 |
| CN | 2514012 | Y | 10/2002 |

(Continued)

OTHER PUBLICATIONS

Abbey, Barbara, "The Complete Book of Knitting", Dover Publications, https://books.google.com/books?d=CfbilcoTz6YC, Apr. 1, 2001 Only two portions have been provided in one page. The portion of p. 19 is not legible.

(Continued)

*Primary Examiner* — Danny Worrell
(74) *Attorney, Agent, or Firm* — Van Hoven PC; Stefan D. Osterbur; Joshua Van Hoven

(57) ABSTRACT

Example apparatuses and methods are directed to knitting needles or tools and/or methods of making the same. In some implementations, a method of making a knitting needle includes providing a first member formed of a first material, and securing one or more additional members to an end of the first member with interference press-fit. The additional member(s) may be formed of a second material different from the first material. In some examples, a knitting needle is provided that includes a first member formed of a first material and one or more additional members secured to an end of the first member with interference press-fit. The additional member(s) may be formed of a second material different from the first material.

20 Claims, 6 Drawing Sheets

(56) References Cited

U.S. PATENT DOCUMENTS

| | | | |
|---|---|---|---|
| 2,096,482 | A | 10/1937 | Cook et al. |
| 2,096,483 | A | 10/1937 | Cook |
| 2,102,600 | A | 12/1937 | Miller |
| 2,118,210 | A | 5/1938 | Luther |
| 2,128,871 | A | 8/1938 | Wong |
| 2,133,431 | A | 10/1938 | Craft |
| 2,183,791 | A | 12/1939 | Dunn |
| 2,208,124 | A | 7/1940 | Robert |
| 2,230,495 | A | 2/1941 | Walter |
| 2,242,880 | A | 5/1941 | Dunn |
| 2,258,925 | A | 10/1941 | Burg |
| 2,462,473 | A | 2/1949 | Delaney |
| 2,507,174 | A | 5/1950 | Phillips |
| 2,535,315 | A | 12/1950 | Morrison |
| 2,633,720 | A | 4/1953 | Robbins |
| 2,668,429 | A | 2/1954 | Barsky |
| 2,693,095 | A | 11/1954 | Slingsby |
| 2,695,506 | A | 11/1954 | Walter |
| 2,817,221 | A | 12/1957 | Newton |
| 3,097,474 | A | 7/1963 | Rohdenburg |
| 3,212,301 | A | 10/1965 | Sumegi |
| 3,280,595 | A | 10/1966 | Linstead |
| 3,384,220 | A | 5/1968 | Linstead |
| 3,540,452 | A | 11/1970 | Usher et al. |
| 3,603,115 | A | 9/1971 | Elzey et al. |
| 3,927,538 | A | 12/1975 | Martella |
| 3,986,468 | A | 10/1976 | Szostak et al. |
| 4,007,610 | A | 2/1977 | Linstead |
| 4,108,701 | A | 8/1978 | Stanley |
| D250,194 | S | 11/1978 | Hanyu |
| 4,195,496 | A | 4/1980 | Vasquez et al. |
| 4,341,094 | A | 7/1982 | Heide |
| 4,494,387 | A | 1/1985 | Phipps et al. |
| 4,501,133 | A | 2/1985 | Kretzschmar et al. |
| 4,553,410 | A | 11/1985 | Okada |
| 4,607,505 | A | 8/1986 | Dunker et al. |
| 4,646,543 | A | 3/1987 | Okada |
| 4,680,947 | A | 7/1987 | Phipps, Sr. et al. |
| 4,693,094 | A | 9/1987 | Kahn |
| 4,846,351 | A | 7/1989 | Gardiner |
| 5,008,984 | A | 4/1991 | Levy |
| 5,211,710 | A | 5/1993 | Nagano |
| 5,303,498 | A | 4/1994 | Yutori et al. |
| D362,539 | S | 9/1995 | Vigil |
| 5,720,187 | A | 2/1998 | Matuo |
| 6,397,640 | B1 | 6/2002 | Williams |
| 6,668,597 | B2 | 12/2003 | Robinson |
| 6,983,627 | B1 | 1/2006 | Eley-Holden-Sotnik |
| 7,117,693 | B1 | 10/2006 | Nova |
| D615,747 | S | 5/2010 | Lindahl |
| 7,954,342 | B2 | 6/2011 | Devagnanam |
| 8,181,489 | B2 | 5/2012 | Selter |
| 8,210,003 | B2 | 7/2012 | Zheng |
| 8,464,559 | B2 | 6/2013 | West et al. |
| 8,499,586 | B1 | 8/2013 | Adam |
| D735,469 | S | 8/2015 | Rastogi |
| D735,776 | S | 8/2015 | Rastogi |
| 9,181,641 | B1 | 11/2015 | Moraca |
| 10,443,164 | B1 | 10/2019 | Zheng et al. |
| 10,619,273 | B2 | 4/2020 | Zheng et al. |
| 11,060,216 | B2 | 7/2021 | Zheng |
| 11,220,767 | B2 * | 1/2022 | Jitsuda ..... D04B 3/02 |
| 11,299,830 | B2 | 4/2022 | Zheng |
| 12,139,829 | B2 * | 11/2024 | Zheng ..... D04B 3/02 |
| 2003/0145442 | A1 | 8/2003 | Hoshino |
| 2010/0139059 | A1 | 6/2010 | Nagai |
| 2011/0197636 | A1 | 8/2011 | Selter |
| 2012/0118021 | A1 | 5/2012 | Zheng |
| 2019/0203391 | A1 | 7/2019 | Rasch |
| 2019/0284736 | A1 | 9/2019 | Zheng et al. |
| 2020/0040494 | A1 | 2/2020 | Zheng |
| 2021/0087723 | A1 * | 3/2021 | Zheng ..... D04B 3/02 |

FOREIGN PATENT DOCUMENTS

| | | | |
|---|---|---|---|
| CN | 202865519 | U | 4/2013 |
| DE | 4308715 | A1 | 9/1993 |
| DE | 20116646 | U1 | 12/2001 |
| DE | 20117288 | U1 | 2/2003 |
| GB | 404798 | A | 1/1934 |

OTHER PUBLICATIONS

Clara Parkes, "ChiaoGoo Twist and Spin Interchangeable Needles", Electronic Colloquium, dated Nov. 28, 2012, Knitter's Review (4 pages).

Clara Parkes, "Knit Picks Options", Electronic Colloquium, dated Jun. 29, 2006, Knitter's Review (4 pages).

DyakCraft webpage from Internet Archive (https://web.archive..org/web/20160529000418/http://www.dyakcraft.com:80)store/p12/Heavy_Metal%E2%84%A2_Tips.html), dated May 28, 2016, 2 pages.

International Search Report and Written Opinion for Application No. PCT/US19/22396 dated May 23, 2019 (10 pages).

"The Wayback Machine" accessed from https://web.archive.org/web/20121115042233/http://www.knitterspride.com/MaterialwiseDetails.asp?id=16&mcid=1, accessed on Jul. 19, 2024.

"New Signature Convertible Needles" accessed from http://susanbanderson.blogspot.com/2013/06/new-signature-convertible-needles.html?m=1, accessed on Jul. 19, 2024.

Advertisement for a Signature Knitting Needle, appearing in Vogue knitting Magazine, Fall 2011 issue (p. 32).

* cited by examiner

MULTI-MEMBER KNITTING NEEDLES AND METHODS FOR MAKING THE SAME

CROSS REFERENCE TO RELATED APPLICATION

The present application claims the benefit of U.S. Provisional Patent Application No. 63/455,859, filed on Mar. 30, 2023, which is hereby incorporated by reference herein in its entirety.

FIELD

This disclosure relates to knitting needles and methods of making the same. More particularly, this disclosure relates to knitting needles that have a multi-part or multi-member construction.

BACKGROUND

The background description provided herein is for the purpose of generally presenting the context of the disclosure. Work of the inventors hereof, to the extent the work is described in this background section, as well as aspects of the description that may not otherwise qualify as prior art at the time of filing, are neither expressly nor impliedly admitted to be prior art against the subject matter of the present disclosure.

Knitting needles are generally known, such as those described in U.S. Pat. Nos. 11,299,830, 10,619,273, 8,210,003, and U.S. Patent Pub. No. 2022/0349095. Disclosures of these patents and publications are hereby incorporated by reference in their entireties for all purposes. A circular knitting needle, such as those disclosed in these patents and publications, generally includes two knitting needles joined by a flexible cable.

Knitting needles may be formed generally of a single monolithic piece or multiple parts or members. It is typical for yarn to slide along the knitting needle during knitting, and therefore it is desired that the knitting needles provide desired smoothness or other frictional properties. To the extent a knitting needle may have multiple parts or members, interfaces between the parts or members are created, leading to potential gaps or discontinuities along the knitting needle. These gaps or discontinuities may catch yarn as it slides along the knitting needle. A multi-member needle construction also complicates assembly and has potential for loosening or disassembly. For example, gluing or bonding, or crimping is typically used in the prior-art construction. Gluing or bonding material may drip or run during assembling. Glued/bonded joints or crimped joints may weaken or fail over time. Accordingly, there is a need for an improved knitting needle and method of making the same that addresses these shortcomings.

SUMMARY

In at least some example approaches a method of making a knitting needle includes providing a first member formed of a first material. The method may also include securing a second member and a third member to opposite ends of the first member. The second member and third member may each be secured to the first member with an interference press-fit. The second member and third member may each be formed of a second material that is different from the first material.

In another example illustration, a method of making a knitting needle includes providing a first member formed of a first material. The method may also include securing a needle tip to an end of the first member. The needle tip is formed of a second material different from the first material. In at least some examples, securing the needle tip to the end of the first member includes inserting a male part into a bore and providing an interference press-fit of the male part with the bore.

In another example illustration, a knitting needle includes a first member formed of a first material. The knitting needle may also include a second member and a third member secured to the first member at opposite ends of the first member. The second member and third member may each be formed of a second material different from the first material. At least one of the second member and the third member may be secured to the first member with an interference press-fit between a bore and a male part received in the bore. Additionally, in at least some examples, an outside diameter of the male part is at least 0.01 millimeters larger than an inside diameter of the bore.

BRIEF DESCRIPTION OF THE DRAWINGS

Further features of the disclosure, its nature, and various advantages will be apparent upon consideration of the following detailed description, taken in conjunction with the accompanying drawings, in which like reference characters refer to like parts throughout, and in which.

DETAILED DESCRIPTION

Figure 1A:
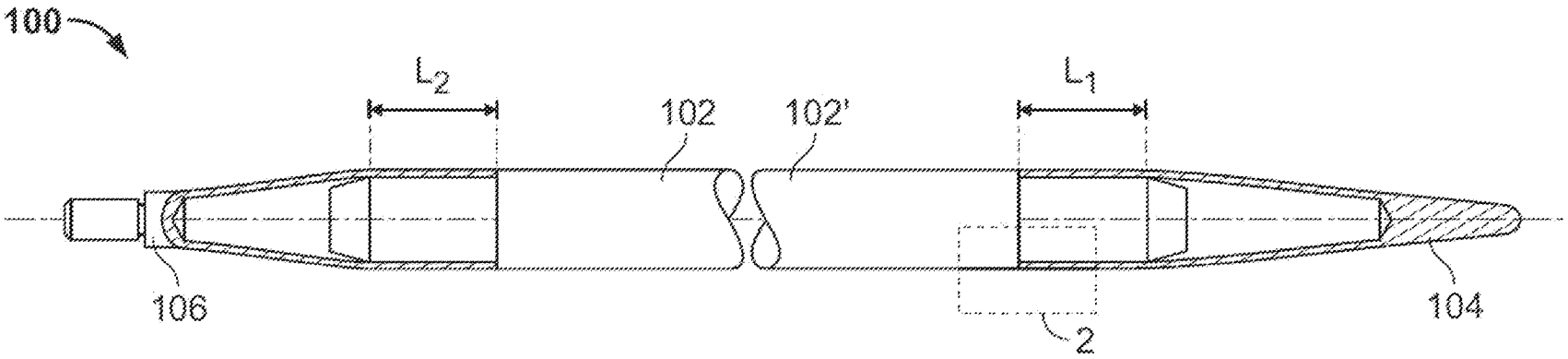
FIG. 1A is a partial cutaway view of a knitting needle formed of multiple parts or members, in accordance with an example illustration.

Example approaches herein may be generally directed to a knitting needle or other knitting tool that employs a multi-part or multi-member construction. As used herein, different parts being assembled together in examples herein may be separate members having respective different characteristic materials. The members may be joined together to form the knitting needle, thereby offering the assembled knitting needle characteristics of the different materials at respective areas of the knitting needle. For example, a first member such as a needle body may be formed of a first material and may have two ends. One or more additional members, such as a needle tip and/or a needle connector, may be formed of a second material that is different from the first material. Example knitting needles may be any size or configuration that is convenient. Accordingly, the examples illustrated and described herein, and dimensions, relative sizes, relationships, etc. are exemplary only and are not limiting.

In some example approaches herein, multi-member knitting needles may be assembled with an interference press-fit process, e.g., where a male part is inserted into a bore with a press force. Different members or parts may be assembled in this manner to avoid the need of glue or bonding agents, or the like to keep the parts securely assembled.

Additionally, example approaches may have a relatively smooth interface between the assembled parts, members or materials comprising the knitting needle. Example approaches may be applied to any knitting needle or other multi-member tool where relatively smooth interfaces between members or security of the connection between members are desired. In some example approaches, a grinding process is employed where a grinding tool is applied to two adjacent members, e.g., a surface of the grinding tool is applied to both a knitting needle body and tip member or connector member. Accordingly, the assembled multi-member knitting needle may provide distinct characteristics of the two members or materials. Merely by way of example, a stainless-steel material may be employed for a needle tip and/or a needle connector, while a different material is employed for a needle body. The different material may be, merely by way of example, carbon fiber, wood, bamboo, aluminum, or any other material that is convenient. The assembled knitting needle may provide distinctly different frictional characteristics as a result of the two different members and/or materials. For example, relatively harder and smoother stainless-steel needle tips may result in relatively reduced friction with yarn in comparison to the needle body, e.g., formed of carbon fiber, wood, bamboo, or aluminum.

Referring to FIGS. 1A-1D, an example knitting needle 100 is illustrated and described in further detail. Knitting needle 100 may include a first member 102 having an outer surface 102'. The first member 102 may be formed entirely or in part of a first material. Example materials for the first member may include metallic materials (e.g., aluminum) as well as non-metallic materials. In an example, the first material is a non-metallic material such as carbon fiber, wood, or bamboo. Further, the outer surface 102' may be defined entirely by the first material. In such case, the first member 102 may be formed entirely of the first material, e.g., in a single monolithic piece. However, in other examples multiple different materials may be used to form the first member 102, e.g., with a first material defining the core of the first member 102 and a different material or coating, such as nano coating material, being disposed on a surface of the core to define an outer surface 102'.

Figure 1B:
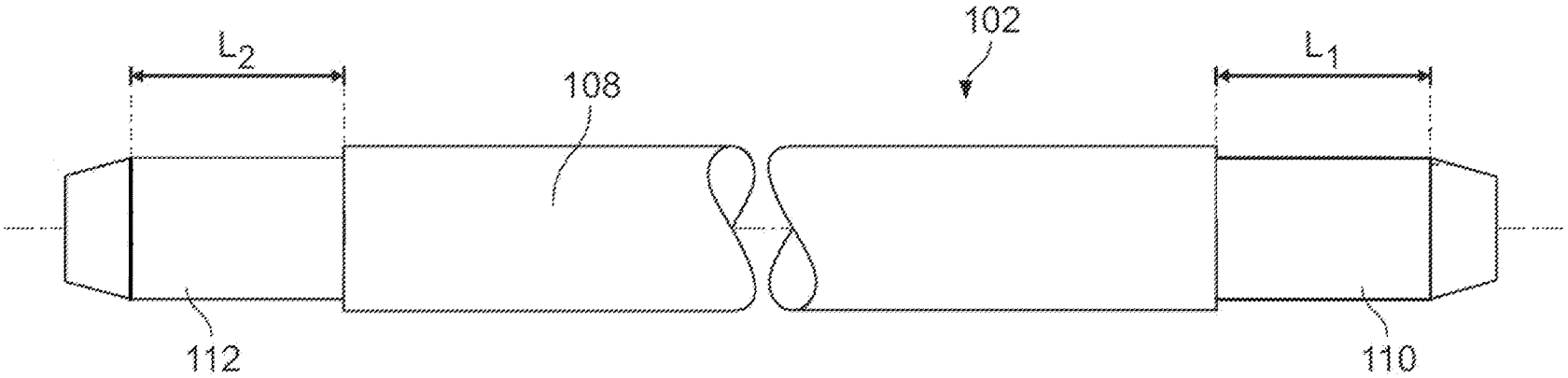
FIG. 1B is a top view of a knitting needle body member of the knitting needle of FIG. 1A, in accordance with an example illustration.

The first member 102 may generally have one or more male ends, e.g., with a male part or other projection configured to be received within a corresponding female part, e.g., with a bore or other cavity, of the knitting needle 100. For example, the first member 102 may generally have a main body 108 defining the outer surface 102', and two male parts 110 and 112. As illustrated in FIGS. 1A and 1B, the male parts 110 and 112 may be disposed at opposite ends of the main body 108. The male part 110 may include a cylindrical portion extending a length $L_1$. The male part 112 may include a cylindrical portion extending a length $L_2$. The male parts 110 and 112 may each have an identical outer diameter $D_M$ as illustrated. However, in other examples the outer diameters of the male parts 110 and 112 may be different. Moreover, the male parts 110 and 112 may have any shape or configuration that is convenient.

Generally, the knitting needle 100 may have one or more additional members that are secured to the first member 102. For example, the knitting needle 100 may have a second member 104 with an outer surface 104'. The second member 104 generally provides a needle tip, e.g., narrowing to a rounded point typical for knitting. The knitting needle 100, in at least some examples, may also have a third member 106 with outer surface 106'. The third member 106 may be a needle connector, e.g., facilitating connection of the knitting needle 100 to a knitting needle cable, as will be described further below, to facilitate use as a circular knitting needle. Alternatively, the third member 106 may also be a needle tip similar or identical to the second member 104, to facilitate use as a double-pointed knitting needle.

Second member 104 and/or third member 106 may be formed of a second material that is different from the first material of the first member 102. In an example, the second material is a metallic material such as stainless-steel. Additionally, the outer surfaces 104' and 106' may be defined entirely by the second material. In some approaches second member 104 and/or third member 106 are formed entirely of the second material, e.g., as respective single monolithic pieces. However, in other examples multiple different materials may be used to form the second member 104 and/or the third member 106. For example, the second member 104 and/or the third member 106 may comprise a core material, with another material or coating, such as a nano coating material, being disposed around the core material to define the outer surface 104' and/or the outer surface 106'.

The second member 104 and/or the third member 106 may have a bore to define a female part. Accordingly, the second member 104 and/or the third member 106 may be configured to receive their respective male parts 110 and/or 112 of the first member 102. In an example, the second member 104 includes a bore 114 and the third member 106 includes a bore 116. Each of the bores 114, 116 define an inner diameter $D_B$. In the example illustrated in FIGS. 1A-1D, the inner diameters $D_B$ are identical, however in other approaches the bore diameters may be different.

Figure 1C:
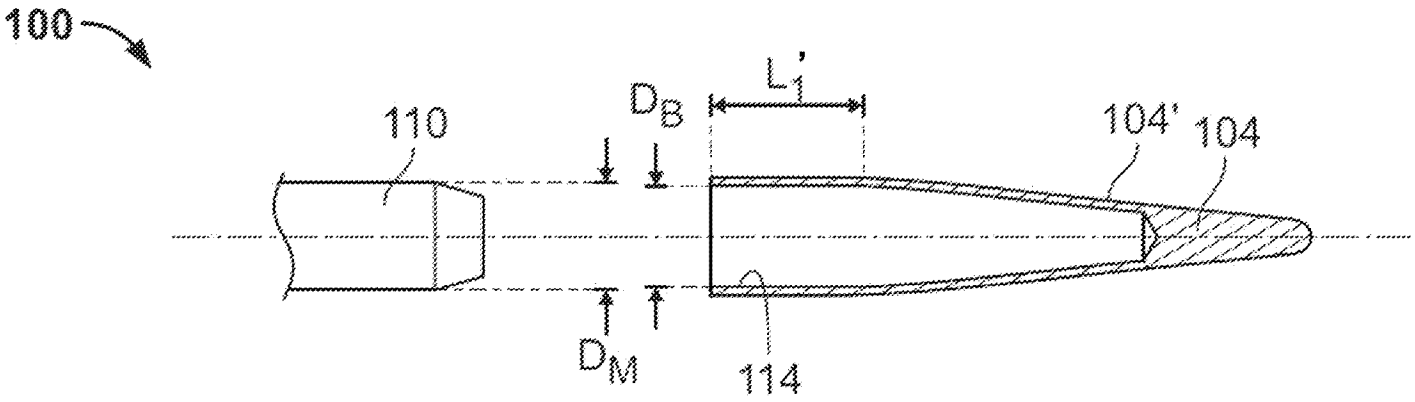
FIG. 1C is a top view of a knitting needle tip member of the knitting needle of FIG. 1A, shown being assembled to a knitting needle body member, in accordance with an example illustration.
Figure 1D:
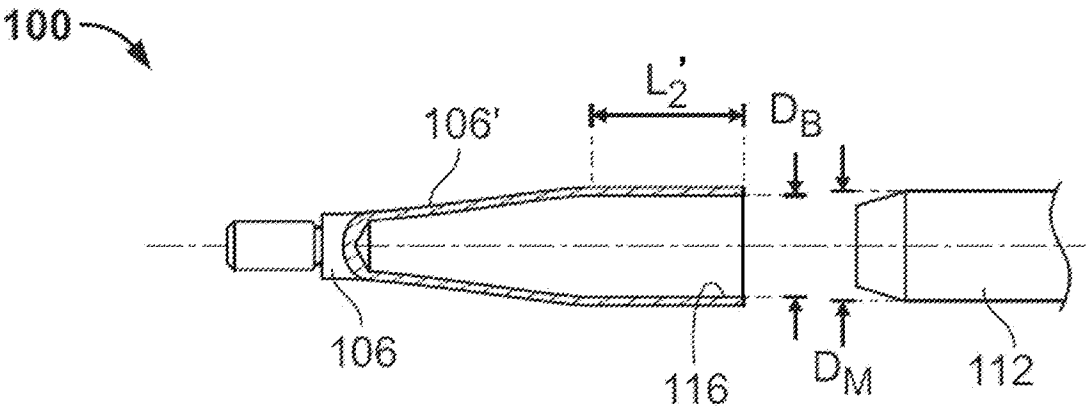
FIG. 1D is a top view of a knitting needle connector member of the knitting needle of FIG. 1A, shown being assembled to a knitting needle body member, in accordance with an example illustration.

As best seen in FIGS. 1C and 1D, the bores 114, 116 may have respective lengths $L_1'$ and $L_2'$. In an example, the length $L_1'$ is at least as great as the length $L_1$ of the male part 110, and the length $L_2'$ is at least as great as the length $L_2$ of the male part 112. Accordingly, sufficient axial or longitudinal space within the second and third members 104, 106 is provided for insertion of the male parts 110, 112.

As noted above, in at least some example approaches, an interference press-fit may be provided between corresponding members, e.g., male parts 110/112 and their corresponding bores 114/116. For example, an outer diameter $D_M$ of the male part 110 may be larger than the diameter $D_B$ of the corresponding bore 114 of the second/tip member 104. As will be discussed further below, the degree to which the diameter $D_M$ is larger than the diameter $D_B$ may be relatively small, allowing the male part 110 to be inserted into the member 104. At the same time, the size difference should be significant enough to provide interference sufficient to resist pulling the male part 110 out of the tip member 104 by hand.

In an example, e.g., where the member 102 is formed of a carbon fiber material and the member 104 is formed of a stainless-steel material, a minimum joining force may be achieved by an interference of at least 0.01 millimeters (mm). For example, the male part 110 may have an outer diameter $D_M$ that is at least 0.01 mm larger than an inside diameter $D_B$ of the bore 114 of tip member 104. Similarly, the male part 112 may have an outer diameter $D_M$ that is at least 0.01 mm larger than an inside diameter $D_B$ of the bore 116 of connector member 106.

Additionally, as noted above, an outer surface of the knitting needle 100 including an interface between the first material and the second material may be relatively smooth. As will be discussed further below, in some examples, a grinding, polishing or other process may be employed that is simultaneously applied to the outer surfaces 102' and 104' of the first member 102 and the second member 104, respectively. Accordingly, the adjacent outer surfaces 102' and 104' are smoothed together as a result of the process. It should be noted that in examples where the first member 102 is a finished part before assembling, e.g., anodized aluminum, etc., grinding or polishing of the outer surface 102' may not be necessary or desired after assembling.

As noted above, in at least some examples, an interference press-fit is provided between corresponding members of the knitting needle 100, e.g., between male part 110 and the bore 114 of second member 104, or between male part 112 and the bore 116 of third member 106. The male part may be relatively larger in diameter than the corresponding bore. In an example, one or both outside diameters $D_M$ of the male parts 110 and 112 is at least 0.01 millimeters larger than the corresponding inside diameters $D_B$ of the corresponding female part (i.e., of bores 114 and/or 116).

Generally, an interference press-fit, as described above, may facilitate a relatively fast assembling and solid connection without using glue, bonding agents, or other additional materials, or other construction method. Accordingly, the knitting needle 100 may generally avoid associated disadvantages of previous multi-member construction methodologies, e.g., imprecision in construction may result in an insecure connection after assembling, potentially leading to connection failures during product lifetime. Additionally, glue or other bonding agents may compromise the outer surface of the needle due to residue escaping from the joint to the outer surface.

In at least some examples, a joining force between the male part, e.g., male part 110 or 112, and the female part of second member 104 or third member 106, is configured to resist a pulling force of at least 1.0 kilograms (kg). It should be noted that resistance to pullout may be influenced by a magnitude of interference between male/female parts and a length of the joint between male/female parts. Diameter of the knitting needle member(s) also influences size of the joint and corresponding resistance to pullout. Accordingly, relatively smaller pullout forces (less than 1.0 kg) may be acceptable in some cases, particularly for relatively smaller diameters (e.g., 2.0 millimeters or less) of the knitting needle. By contrast, where knitting needles have relatively larger diameters (i.e., larger than 2.0 millimeters), resistance to pullout of the male parts 110, 112 from their respective female parts may be relatively greater, and in some cases significantly greater. The degree to which interference is created between male/female parts, along with material selections of the male/female parts, may also influence pullout force. In some cases, an interference of 0.01 millimeters is sufficient to create adequate resistance to pullout. In other examples, particularly where the male member is formed of a relatively softer material than the female part, e.g., the male part is formed of wood or bamboo while the female part is formed of stainless-steel, a relatively larger interference of 0.02-0.04 millimeters may be employed.

After the male part 110 is inserted into the bore 114 and the male part 112 is inserted into the bore 116, the male parts 110/112 are in contact with corresponding radially inwardly facing surfaces of the bores 114/116, respectively. In the illustrated example shown in FIGS. 1A-1D, male part 110 comprises a generally cylindrical male contact surface extending axially along a length $L_1$. Similarly, male part 112 comprises a generally cylindrical male contact surface extending axially along a length $L_2$. These cylindrical male contact surfaces face radially outwardly and contact the radially inwardly facing female contact surfaces of bores 114/116 upon insertion into the bores 114/116. Accordingly, each of the bores 114 and 116 may define radially inwardly facing female contact surfaces extending an axial length that are at least as great as the axial lengths $L_1$ and $L_2$, respectively. Any length of the male/female contact surfaces may be employed that is convenient. In an example, the axial length $L_1$ of the male contact surface of the male part 110 in contact with the radially inwardly facing surface of the bore 114 is at least 2.0 millimeters. In an example, the axial length $L_2$ of the male contact surface of the male part 112 in contact with the radially inwardly facing female contact surface of the bore 116 is at least 2.0 millimeters. In at least some examples, a greater axial length of the male/female contact surfaces may be employed, further increasing resistance of the male part from being withdrawn from its corresponding female part. Generally, example illustrations using an interference press-fit assembling process facilitate sufficient resistance to pullout of the male part from its corresponding female part to ensure that parts formed with different materials remain fully engaged, thereby preventing formation of any gap between outer surfaces of the members. As a result, yarn or other knitting mediums may smoothly transition across an interface between member 104 and member 102 as it moves along the knitting needle 100.

Male and/or female parts may, in at least some example approaches, have angled ends, tapers, chamfers, or the like to facilitate insertion of a male part into a corresponding female part. For example, as illustrated in the example knitting needle 100 in FIGS. 1A-1D, each of the male parts 110 and 112 are provided with chamfers 113. Accordingly, initial insertion of the male parts 110 and 112 is made relatively easier. Additionally, the chamfers 113 allow for a more gradual increase or "ramping up" of insertion force as the male part 110/112 is axially moved into the corresponding bore 114/116.

As noted above, example knitting needles, e.g., knitting needle 100, may provide a relatively smooth interface between different parts or members that are press-fit or otherwise secured together. In at least some example approaches, an interface between different parts may be ground or polished with a grinding surface.

Figure 2A:
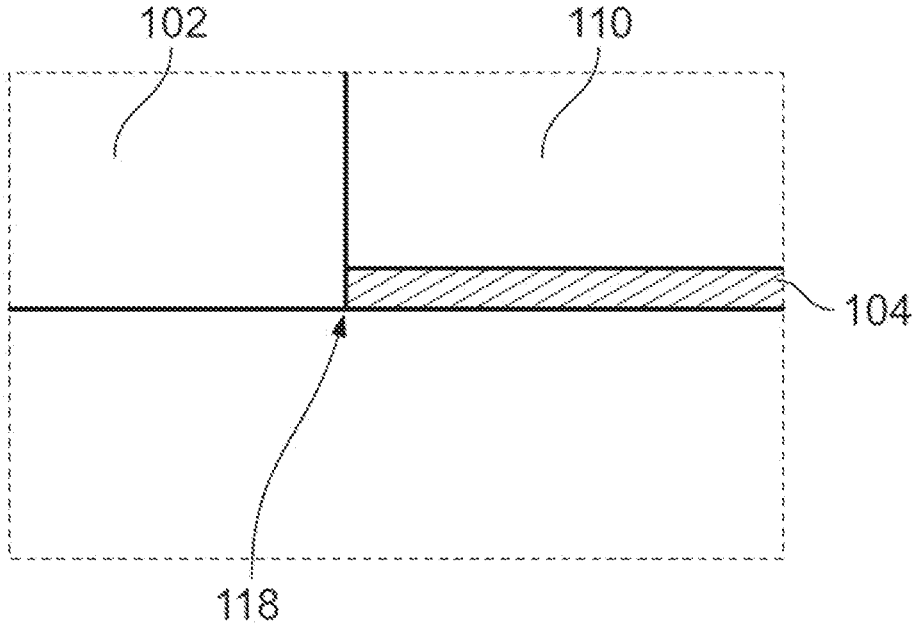
FIG. 2A is a portion of FIG. 1A, enlarged to show an interface region between the knitting needle body member and knitting needle tip member, in accordance with an example illustration.
Figure 2B:
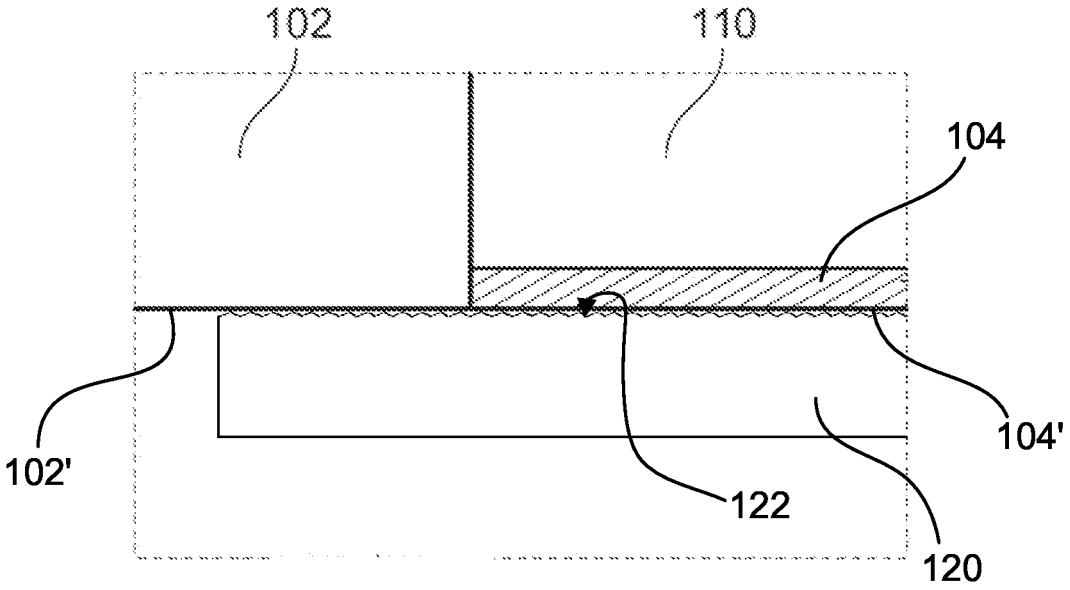
FIG. 2B is the interface region of FIG. 2A, shown with a grinding surface for grinding and/or polishing the interface region, in accordance with an example illustration.
Figure 2C:
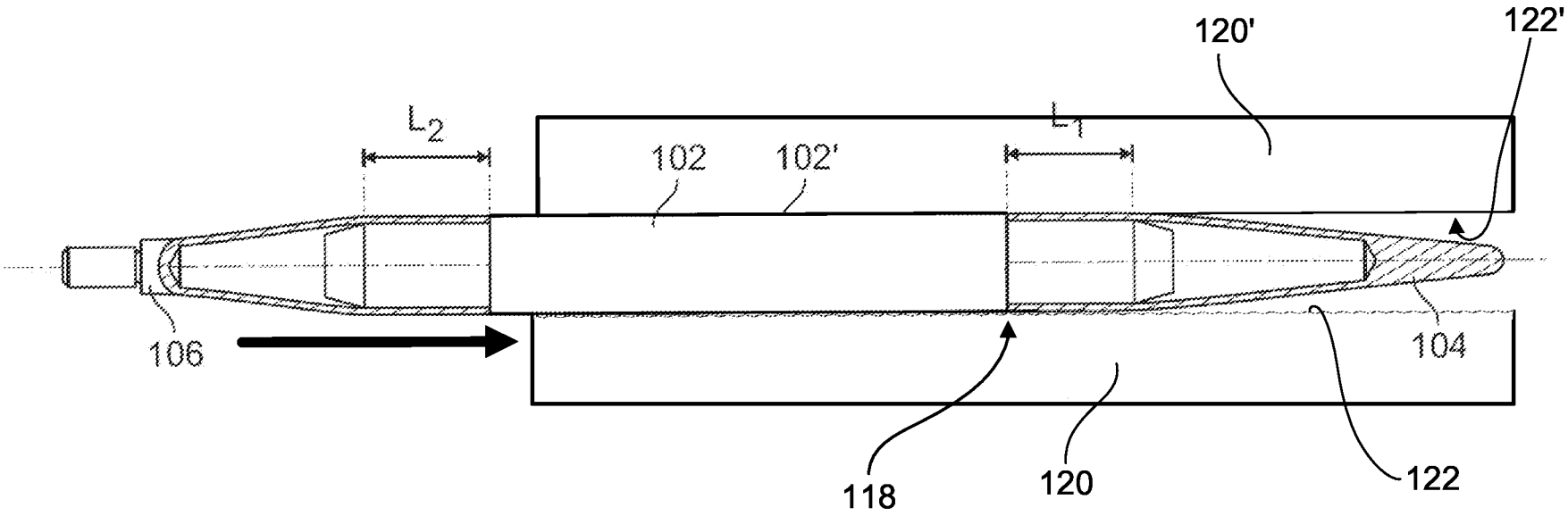
FIG. 2C is a top view of a knitting needle formed of multiple parts or members being ground by a grinding surface or tool, in accordance with an example illustration.

Referring now to FIGS. 2A-2C, an example smoothing operation (e.g., grinding or other material removal process, polishing, etc.) with respect to the tip member 104 and first member 102 is illustrated. FIGS. 2A and 2B illustrate an interface 118 between tip member 104 and first member 102, enlarged for clarity. As noted above, the male part 110 may be relatively larger in diameter than the corresponding bore (e.g., bore 114) of tip member 104. While not visible in FIG. 2A, upon initial assembly of the tip member 104 to the first member 102, the tip member 104 and/or outer surface 104' thereof may be deflected slightly radially outwardly as a result of tolerances associated with the first member 102 and/or the tip member 104. Generally, any radial deflection as result of interference press-fit or mismatch between the outer surface 102' of the first member 102 and the adjacent outer surface 104' of the tip member 104 may be removed by way of example grinding or smoothing processes as discussed herein. Accordingly, the tip member 104 and first member 102 may have an equal diameter or otherwise may provide a relatively smooth interface region 118, as illustrated in FIG. 2B.

As seen in FIG. 2B, a grinding tool 120 may be provided having a grinding surface 122. The grinding surface 122 may be applied to the interface region 118 and may be moved relative to the interface region 118, e.g., by rotating the grinding tool 120. Accordingly, the grinding surface 122 may smooth or grind the different materials of the first member 102 and the second member 104 simultaneously. In an example, the grinding surface 122 has a grit number greater than 100, and in some cases significantly greater. The application of the grinding surface 122, e.g., simultaneously, to outer surfaces 102' and 104' of the interface 118 may facilitate formation of a smooth outer surface of the knitting needle 100 across the interface 118. In at least some example approaches, a machining process is employed to apply the grinding tool 120 and/or grinding surface 122 to ensure that, e.g., a non-metallic first member 102 and metallic tip member 104 may have a same outside diameter. In this manner, the diameters of the first member 102 and tip member 104 are identical to an extent that any diameter difference between the first member 102 and tip member 104 is limited to differences in surface texture or smoothness. In at least some examples, a further machining process may be employed with a relatively finer grit, e.g., to remove scratches or marks that may occur during press-fitting and grinding processes, or simply to further improve surface smoothness. Merely by way of example, a polishing process may be applied, e.g., manually or by hand, using fabric together with a wax.

Turning now to FIG. 2C, an example grinding process is schematically illustrated and described in further detail. In the example illustrated, a centerless grinding process may be employed so that a grinding surface 122 is applied against the knitting needle 100. More specifically, a first grinding tool 120 having a grinding surface 122 is positioned adjacent to a secondary tool 120' with a secondary surface 122' such that a gap is defined between the surfaces 122 and 122'. First grinding tool 120 may have a desired roughness, e.g., a grit number exceeding 100. The secondary surface 122' of the secondary tool 120' may be relatively smoother than the grinding surface 122, e.g., with a relatively higher grit number. The secondary tool 120' may serve primarily as a guide while the grinding surface 122 is applied to the first member 102 and/or second member 104. It should be noted that the roughness of the grinding surface 122 is visually exaggerated in the figures, and in at least some examples a grinding operation may only remove 0.1-0.2 millimeters of material from the first member 102 and/or second member 104. The first member 102 and second member 104, assembled together, may be moved axially (indicated by the arrow in FIG. 2C) into the gap between the surfaces 122, 122' such that the grinding surface 122 progressively grinds or polishes along the members 102 and 104. The first surface 122 may move, e.g., as a result of rotation of the tool 120 about an axis parallel to the axial movement of the first member 102, while the second surface 122' may move at a relatively slower rate, e.g., due to a relatively slower rotation speed of the secondary tool 120' in comparison to the first grinding tool 120. Accordingly, the second member 104 may contact the surfaces 122, 122' initially. As the assembled first and second members 102, 104 move progressively further along the surfaces 122, 122', the entire first member 102 and interface region 118 between the first member 102 and second member 104 are ground or smoothed. Accordingly, grinding surface 122 is applied progressively along an entire length of the first member 102 and the interface regions 118 at either ends thereof. At one or more times during this example process, the grinding surface 122 may be simultaneously applied to at least a portion of the first member 102 and a portion of the second member 104 and/or third member 106, as well as an interface region 118 therebetween.

Example grinding and polishing processes described above may be convenient in the context of different materials used for the first member 102 and second member 104. For example, a carbon fiber first member 102 and outer surface 102' thereof may be ground and polished properly to provide a desired frictional characteristic that differs from the second member 104 and/or third member 106. More specifically, carbon fiber may provide relatively increased drag to a yarn or other knitting medium in comparison to that provided by a stainless-steel second/tip member 104. Additionally, carbon fiber may also provide a drag that is less than other non-metallic materials, e.g., bamboo or wood. In at least some examples, no coating is applied to the surface of the first member 102, in order to promote the desired level of drag of the knitting needle 100. For example, a first member 102, formed with a finished surface, e.g., anodized aluminum, may not need a coating. In other examples, a post-machining or polishing treatment, and/further surface coating, may be applied for a first member 102 formed of carbon fiber or bamboo and/or the second/third members 104/106 formed of another material. Any coating may be applied to first member 102 and/or the second/third members 104/106 that is convenient. In one example, a nano coating may be applied to either improve surface smoothness or to improve certain surface characteristics such as water/moisture proof, anti-corrosion or anti-abrasion characteristics. Example nano coatings may be, merely as one example, a ceramic material.

As noted above, second/third members 104/106, e.g., tip member and connector member, may in some example approaches be formed of a different material than the first member 102, at least along outer surfaces thereof. For example, the tip member 104 and connector member 106 may each be formed of one material, e.g., a metallic material such as stainless-steel or other hard alloys. Generally, it may be desirable that the tip member 104 and/or the connector member 106 are formed of a material that is relatively strong, corrosion resistant, oxidization resistant, light weight, suitable for computer numerical control (CNC) machining to form a desired shape or configuration, and to achieve a desired level of precision and/or surface smoothness. Generally, a sharpness of the tip member 104 and overall shape, precision, surface smoothness and light weight may be achieved from a CNC machining process. Further, metallic materials such as stainless-steel or other hard alloys may provide durability due to their material strength, thereby increasing overall service life of the knitting needle 100.

By comparison, in at least some examples, the first member 102 and/or male parts 110/112 may be formed of different materials than the second/third members 104/106. In some examples, first member 102 is formed from a metallic material such as aluminum, or a non-metallic material such as bamboo, wood, or carbon fiber, merely as examples. These materials may be relatively harder to achieve a correct form or shape with precision, or may lack strength or durability, and as such may be less desirable for use for other knitting needle parts or members, e.g., tip member 104 or connector member 106. These non-metallic materials may however offer a desired surface friction/drag that is advantageous for some specific yarns and/or some specific types of knitting. In at least some examples, carbon fiber may be used for the first member 102, which offers some superior qualities compared to bamboo and wood, such as its strength, resistance to breakage/warping/splitting, and grinding process for precision.

Figure 3:
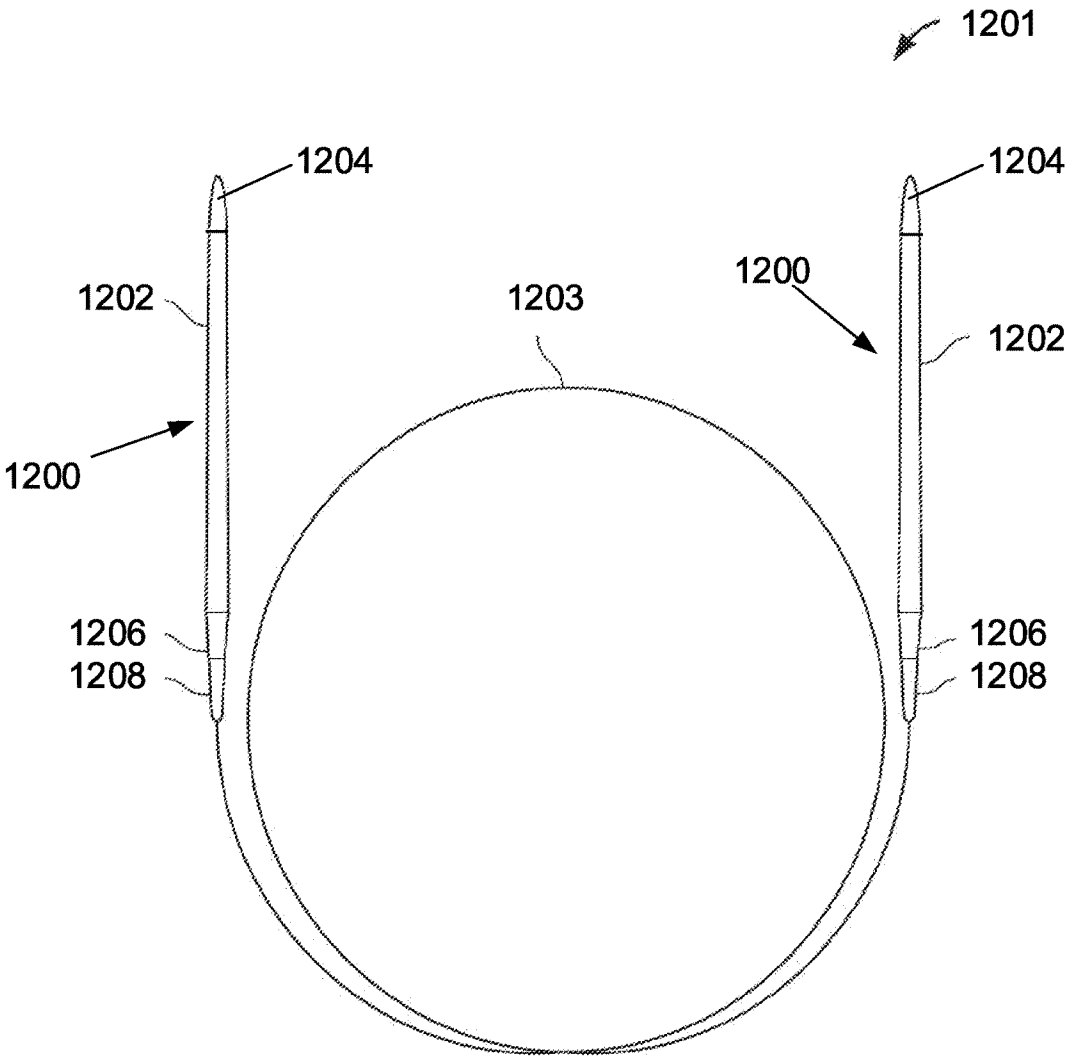
FIG. 3 is a top view of a circular knitting needle including two needles, each secured to a flexible cable, in accordance with an example illustration.

Referring to FIG. 3, an example circular knitting needle 1201 is illustrated having two knitting needles 1200 connected via a cable 1203. An end of each knitting needle 1200 may be secured to a flexible cable 1203. The knitting needles 1200 may, in an example, each be knitting needle 100. Accordingly, both knitting needles 1200 may have multiple parts, e.g., such as a first member 1202 with a second/tip member 1204 and a third/end member 1206. Accordingly, in at least some examples the first members 1202 of each may be first member 102 described above, the second/tip members 1204 may be second member 104 described above, and the third member 1206 may be third member 106 described above. The knitting needles 1200 may be coupled to the cable 1203 in any manner that is convenient. In an example, the end member 1206 of each knitting needle 1200 is coupled to a cable connector 1208 that receives an end of the cable 1203. In some examples, the cable connector 1208 or features thereof may be incorporated into the end member 1206. Further, in some examples the knitting needles 1200 may be coupled to the cable 1203 such that the knitting needles are configured to swivel with respect to the cable 1203, e.g., to prevent cable windup or twisting during knitting.

Figure 4:
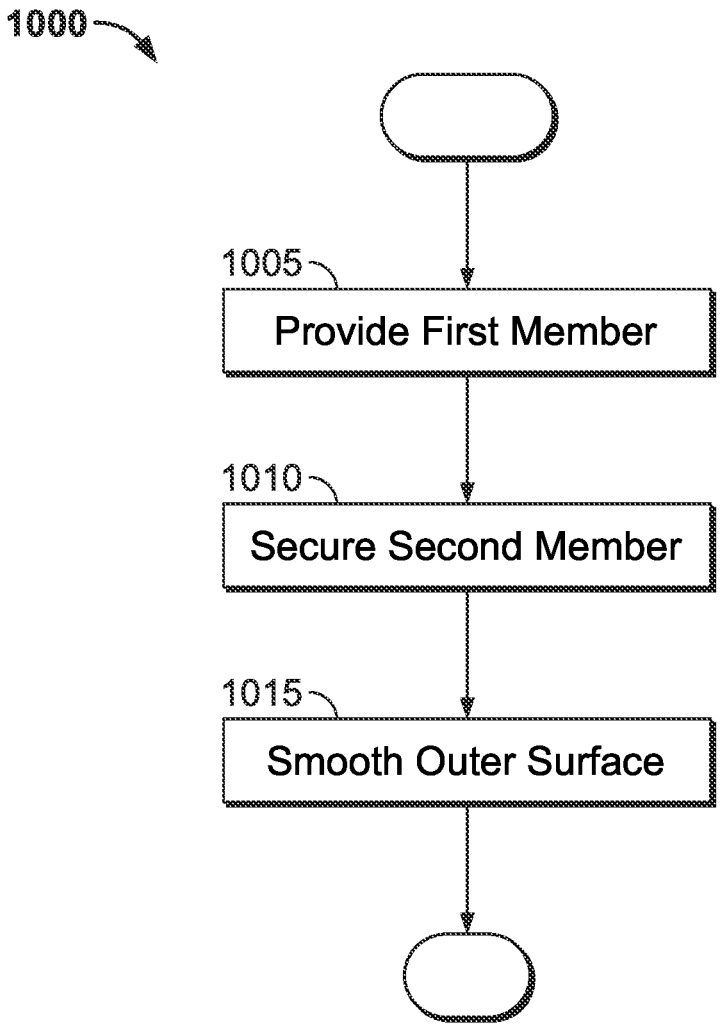
FIG. 4 is a process flow diagram for a method of making a knitting needle, in accordance with an example illustration.

Referring to FIG. 4, an example process 1000 for making or assembling a knitting needle is illustrated and described in further detail.

Process 1000 may begin at block 1005, where a first member is provided that is formed of a first material. For example, first member 102 may be provided that is formed of a non-metallic material, such as carbon fiber, wood, bamboo, etc.

Proceeding to block 1010, a second member is secured to an end of the first member, e.g., at a first end or a second end. For example, a second member may be secured to first member 102, with the second member formed as a tip member 104 or a connector member 106. The second member may, in at least some examples, be formed of a different material than the first member. The first member 102 may have a male end or part, e.g., male part 110 configured to be inserted into a corresponding bore 114 of the second member 104. Accordingly, in such examples securing a second member and/or the third member to the first member may include inserting a male part, e.g., male part 110 or 112, into a female part, e.g., bore 114 of tip member 104. While the first member 102 described above includes the male part 110, in some examples the tip member 104 and/or connector member 106 may be provided with a male part configured to be received in a corresponding female part or bore in first member 102. As noted above, in some examples inserting the male part into the female part may include providing an interference press-fit of the male part, e.g., male part 110 or male part 112, within the corresponding female part, e.g., bore 114 or 116. An interference press-fit may be provided by a relatively enlarged outer diameter of a male part relative to a bore or female/receiving part. For example, as noted above male parts 110 or 112 may be formed with an outer diameter $D_M$ that is at least 0.01 millimeters larger than an inside diameter $D_B$ of the bores 114 or 116, respectively. A joining force between the male part, e.g., male part 110, and the female part, e.g., bore 114, may be configured to resist a pulling force of at least 1.0 kilograms. The male part 110 may have a contact surface extending along the cylindrical portion thereof having an axial length L1, and the male part 112 may have a contact surface extending along the cylindrical portion thereof with an axial length $L_2$. For the contact surfaces of the male part 110, male part 112, and the corresponding bores 114 and 116, the contact surfaces may have an axial contact length of at least 2.0 millimeters (mm), as noted above. Process 1000 may then proceed to block 1015.

At block 1015, an outer surface of the knitting needle may be smoothed, including an interface between the first material and the second material. For example, as described above, a grinding surface, e.g., surface 122 and/or 122', may be applied to outer surface 102' and outer surface 104', thereby smoothing both across the interface region 118. More specifically, in an example grinding surface 122 may be applied to both the first material (i.e., of the outer surface 102') and the second material (i.e., of the outer surface 104'). The grinding surface 122 may, as noted above, have a grit number greater than 100. Process 1000 may then terminate.

Reference herein to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

Regarding any processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments and should in no way be construed so as to limit a claimed invention.

Accordingly, it is to be understood that the above description is intended to be illustrative and not restrictive. Many embodiments and applications other than the examples provided would be upon reading the above description. The scope of inventions herein should be determined, not with reference to the above description, but should instead be determined with reference to the applicable claims, along with the full scope of equivalents to which such claims are entitled. It is anticipated and intended that future developments will occur in the arts discussed herein, and that the disclosed systems and methods will be incorporated into such future embodiments. In sum, inventions described herein are capable of modification and variation and is limited only by the applicable claims.

All terms used in applicable claims are intended to be given their broadest reasonable constructions and their ordinary meanings as understood by those skilled in the art unless an explicit indication to the contrary is made herein. In particular, use of the singular articles such as "a," "the,"

"said," etc. should be read to recite one or more of the indicated elements unless a claim recites an explicit limitation to the contrary.

What is claimed is:

1. A method of making a knitting needle, comprising:

providing a first member formed of a non-metallic material; and securing a second member and a third member to opposite ends of the first member, wherein the second member is a needle tip, the second member and the third member each formed of a metallic material different from the non-metallic material, the second member and the third member each secured to the first member with an interference press-fit of male parts of the first member inserted into respective bores of the second member and the third member, wherein the bores are radially deflected such that a first member outer diameter is mismatched with respect to outer diameters of the second and third members radially overlying the respective male parts at interfaces between the metallic material and the non-metallic material; and smoothing an outer surface of the knitting needle including the interfaces between the metallic material and the non-metallic material to remove the mismatches.

2. The method of claim 1, wherein a joining force between the male part and the bore is configured to resist a pulling force of at least 1.0 kilograms (kg).

3. The method of claim 2, wherein an outside diameter of the male part is at least 0.01 millimeters larger than an inside diameter of the bore.

4. The method of claim 1, wherein the male part defines a male contact surface extending axially along the male part, the male contact surface in contact with a female contact surface extending axially along one of the bores after the male part is inserted, the male contact surface and the female contact surface having an axial contact length of at least 2.0 millimeters (mm).

5. The method of claim 1, wherein smoothing the outer surface includes grinding the first material and the second material with a grinding surface having a grit number greater than 100.

6. The method of claim 1, wherein the metallic material includes a stainless-steel material.

7. A method of making a knitting needle, comprising:

providing a first member formed of a non-metallic material;

securing a needle tip to an end of the first member, the needle tip formed of a metallic material different from the non-metallic material, wherein securing the needle tip to the end of the first member includes inserting a male part of the first member into a bore of the needle tip, wherein inserting the male part into the bore includes providing an interference press-fit of the male part with the bore, wherein the bore of the needle tip is radially deflected such that a first member outer diameter is mismatched with respect to a needle tip outer diameter radially overlying the male part at an interface between the metallic material and the non-metallic material; and smoothing an outer surface of the knitting needle including the interface between the metallic material and the non-metallic material to remove the mismatch.

8. The method of claim 7, wherein an outside diameter of the male part is at least 0.01 millimeters (mm) larger than an inside diameter of the bore.

9. The method of claim 7, wherein smoothing the outer surface includes grinding the first material and the second material by applying a grinding surface having a grit number greater than 100.

10. A knitting needle, comprising:

a first member formed of a non-metallic material; and a second member and a third member secured to the first member at opposite ends of the first member, wherein the second member is a needle tip, the second member and third member each formed of a metallic material different from the non-metallic material;

wherein at least one of the second member and the third member are secured to the first member with an interference press-fit between a bore and a male part received in the bore, and wherein an outside diameter of the male part is at least 0.01 millimeters larger than an inside diameter of the bore;

wherein the bore is radially deflected such that a first member outer diameter is mismatched with respect to an outer diameter of the second member radially overlying the male part at an interface between the metallic material and the non-metallic material; and wherein an outer surface of the knitting needle including the interfaces between the metallic material and the non-metallic material is smoothed to remove the mismatches.

11. The knitting needle of claim 10, wherein the male part defines a male contact surface extending axially along the male part, the male contact surface in contact with a female contact surface extending axially along the bore, the male contact surface and the female contact surface having an axial contact length of at least 2.0 millimeters (mm).

12. The knitting needle of claim 10, further comprising a cable having a first end and a second end, wherein the first end is coupled to one of the second member and the third member, and wherein the second end is coupled to an additional knitting needle.

13. The knitting needle of claim 10, wherein the metallic material is a stainless-steel material.

14. The knitting needle of claim 10, further comprising a nano coating applied to an outer surface of at least one of the first member, the second member, and the third member.

15. The method of claim 1, wherein the radial deflection results from the interference press-fit of the male member with the bore.

16. The method of claim 1, wherein the radial deflection results from a tolerance associated with one of the needle tip and the first member.

17. The method of claim 1, wherein the third member is one of a second needle tip or a connector member.

18. The method of claim 7, wherein the radial deflection results from the interference press-fit of the male member with the bore.

19. The method of claim 7, wherein the radial deflection results from a tolerance associated with one of the needle tip and the first member.

20. The method of claim 7, wherein the mismatch is removed such that cylindrical surfaces of the first member and the needle tip have an equal diameter.

* * * * *